US005120141A

United States Patent [19]

Kieling

[11] Patent Number: 5,120,141

[45] Date of Patent: Jun. 9, 1992

[54] HOUSING FOR A TYPEWRITER OR SIMILAR OFFICE MACHINE

[75] Inventor: Reiner Kieling, Wilhelmshaven, Fed. Rep. of Germany

[73] Assignee: AEG Olympia Office GmbH, Wilhelmshaven, Fed. Rep. of Germany

[21] Appl. No.: 595,811

[22] Filed: Oct. 11, 1990

[30] Foreign Application Priority Data

Oct. 11, 1989 [DE] Fed. Rep. of Germany ..... 3933948

[51] Int. Cl.[5] ..... B41J 3/46; B41J 29/02

[52] U.S. Cl. ..... 400/83; 400/693; 400/690.4; 346/145

[58] Field of Search ..... 400/83, 690-694; 346/145; 312/208

[56] References Cited

U.S. PATENT DOCUMENTS

| | | | |
|---|---|---|---|
| 2,316,617 | 4/1943 | Prezioso | 400/693 |
| 2,810,466 | 10/1957 | Lambert et al. | 400/693.1 |
| 3,180,572 | 4/1965 | Gallant | 400/693 |
| 3,499,517 | 3/1970 | Cappotto | 400/693.1 |
| 4,119,385 | 10/1978 | Watanabe et al. | 400/693.1 |
| 4,212,077 | 7/1980 | Vittorelli | 364/900 |

FOREIGN PATENT DOCUMENTS

| | | | |
|---|---|---|---|
| 2939184 | 12/1982 | Fed. Rep. of Germany . | |
| 0242863 | 10/1986 | Japan | 400/690.4 |

*Primary Examiner*—Edgar S. Burr
*Assistant Examiner*—Christopher A. Bennett
*Attorney, Agent, or Firm*—Spencer, Frank & Schneider

[57] ABSTRACT

A housing for an office machine, the housing having an upper and a lower housing portion. There is a housing cover located in the upper housing portion for covering functional elements of an office machine when the housing is attached to an office machine. A parallel guide between the housing cover and the upper and lower housing portions allows the housing cover to be displaced between open and closed end positions. The housing cover rests closely above a keyboard of an office machine when the housing cover is in its open position and the housing is attached to an office machine, and the housing cover sits in the upper housing covering functional elements of an office machine when the housing cover is in its closed position.

20 Claims, 2 Drawing Sheets

HOUSING FOR A TYPEWRITER OR SIMILAR OFFICE MACHINE

CROSS-REFERENCE TO RELATED APPLICATION

This application claims the priority of Federal Republic of Germany Application Serial No. P 39 33 948.3 filed Oct. 11, 1989, which is incorporated herein by reference.

BACKGROUND OF THE INVENTION

The present invention relates to a housing for a typewriter or similar office machine of the type having a housing cover located in an upper housing portion between a platen and a keyboard. The housing cover is movable from a closed position to an open position in which functional elements, which are movable along the platen, are exposed.

Typewriters and similar machines are known in which an upper part of the housing terminates as a removable cover. Below this cover there are components, such as a printing mechanism movable along the platen, and exchangeable functional elements such as a daisywheel and a ribbon cartridge. After removal of the housing cover, free access is gained to this printing mechanism without having to disassemble the entire housing from the machine. It is possible to arrange the housing cover on the machine so that it can be completely removed from the machine and set aside. Alternatively, such a cover has been fastened to the housing by way of hinge elements and can be folded upwardly. When the housing cover is closed, it is advantageous, and in the folded open position of the housing cover, it is necessary, to arrest the cover in its respective positions by means of locking elements.

More expensive typewriters and word processors are additionally provided with a line display device which displays at least a few of the most recently put in characters before they are printed out on the record carrier or typing paper. The operator is able to check his or her character input on this display device and make corrections, if necessary, before printout.

German Offenlegungsschrift (published unexamined application) 2,742,992, which is a counterpart to U.S. Pat. No. 4,212,077, discloses a typical example of a machine having the display device disposed in the front cover constituting the transition region near the keyboard and between the upper housing member and the lower housing member. For a skilled operator typing by touch with his or her gaze directed onto the platen to observe progress and format of the printed text, this arrangement makes it necessary for his or her eyes to constantly move back and forth between the typed line at a higher level and the display device at a lower level. This back and forth movement of the operator's eyes is necessitated by the need, on the one hand, to check the character input while it still can be corrected and, on the other hand, to monitor the typing progress and, thus, his or her adherence to the intended format.

The solution disclosed in German Offenlegungsschrift (published unexamined application) 2,939,184 overcomes this drawback. In that device, a very small display device is disposed in the immediate vicinity of the typed line, that is, in the region of the type carrier, so that the operator can read the typed line and immediately thereafter follow the not yet typed characters displayed on the display device. However, given its necessarily small size, the manufacture and accommodation of such a display device involves significant technical problems. Additionally, it is difficult for the operator to read the characters, which in such an arrangement can be displayed only in a very small size, owing to the poor reproduction quality of the display as compared to the printed image. Another drawback is that only a few of the most recently put in characters can be displayed at one time. Also, given that the display device is designed to be displaced along the printed line, the display device must be very short. Thus, such a display device can only serve as a monitoring and correction aid for typographical errors noted immediately after input.

SUMMARY OF THE INVENTION

It is an object of the present invention to provide a housing for a typewriter or similar machine including a housing cover which can be moved from a closed position into a position which exposes function elements such as the ribbon cartridge, the daisywheel, and the like, that are disposed on a carriage movable along the typed line. This housing cover is intended to provide better working conditions for the operator. This object is accomplished by the provision in the present invention of the shiftable housing cover.

The housing cover having the features according to the invention makes it possible for the housing cover to remain connected with the housing when it is pushed into the open position, thus permitting easy manipulation. As an advantageous feature, the housing cover is pushed over the keyboard to such an extent that the keys of the latter can not be operated. Accordingly, such positioning of the housing cover in its open position prevents inadvertent inputs or unintentional actuation of functions by accidental striking of the keys.

In addition, an extensive and easily readable line display device, which is tiltable into an infinite number of position for enhanced viewing by different operators, is provided. The display device is located on the housing cover so that the operator need only to change his or her direction of vision over a small range in order to be able to see the typed line on the record carrier or typing paper as well as to see the display on the display device. Therefore, the operator is able to assume and to maintain a substantially natural posture, thus avoiding excessive flexion of the cervical vertebrae and cramping of the dorsal muscles. Work is much less tiring for the operator, and injuries to the cervical vertebrae and to the dorsal muscles are prevented.

Moreover, as the characters are large and clear on the display device, premature ocular fatigue is also prevented.

DESCRIPTION OF THE PREFERRED EMBODIMENTS

Figure 1:
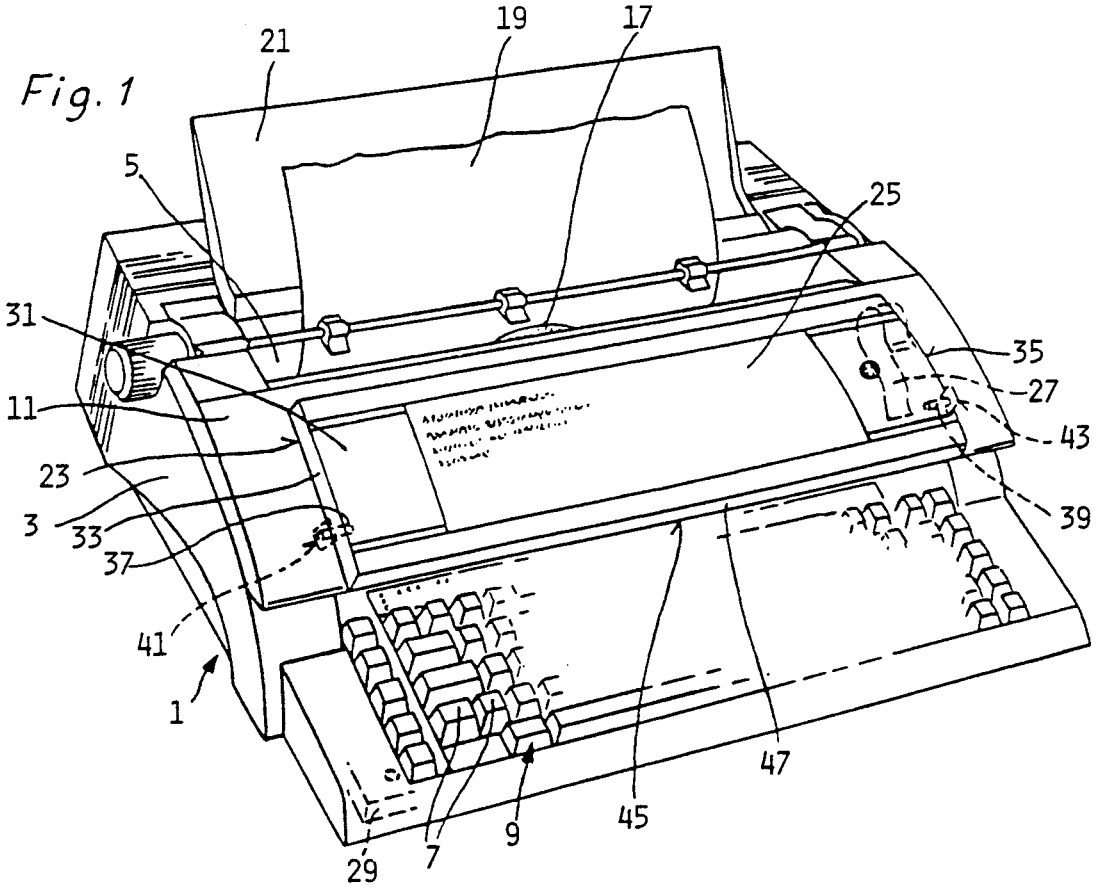
FIG. 1 is a perspective view of a preferred embodiment of a typewriter of the invention.

FIG. 1 shows a housing 1 of a typewriter of the present invention that includes a housing cover 11 located in an upper housing portion 3 between a platen 5 and a keyboard 9 having keys 7. Housing cover 11 can be moved from a normally closed position into an open position which exposes functional elements, such as a ribbon cartridge 15 and a daisywheel 17, arranged on a carriage 13 movable along platen 5. A sheet of paper 19 is advanced in a known manner by driven platen 5 and is removed by way of a paper guide 21. A parallel guide arrangement 20 in upper housing portion 3 shiftably mounts housing cover 11 for movement between its two end positions; i.e., between its open and closed positions. In the open position, housing cover 11 lies closely above and covers the keys 7 of keyboard 9 so that the operator is no longer able to strike the keys.

Additionally, housing cover 11 has a rectangular recess 23 which accommodates a pivotably and lockably mounted display device 25 for displaying at least one complete line of text. Line display device 25, known as a display, is electrically connected, by way of a guide cable 27, with a control device attached to a bottom plate 29 of housing 1.

Line display device 25 is embedded in a frame 31 and is capable of displaying several lines of text. In the middle of its sides 33, 35, frame 31 is provided with bearing pins 37, 39 which are pivotably mounted in bearing bores 41, 43 of housing cover 11.

Figures 2, 3, 4:
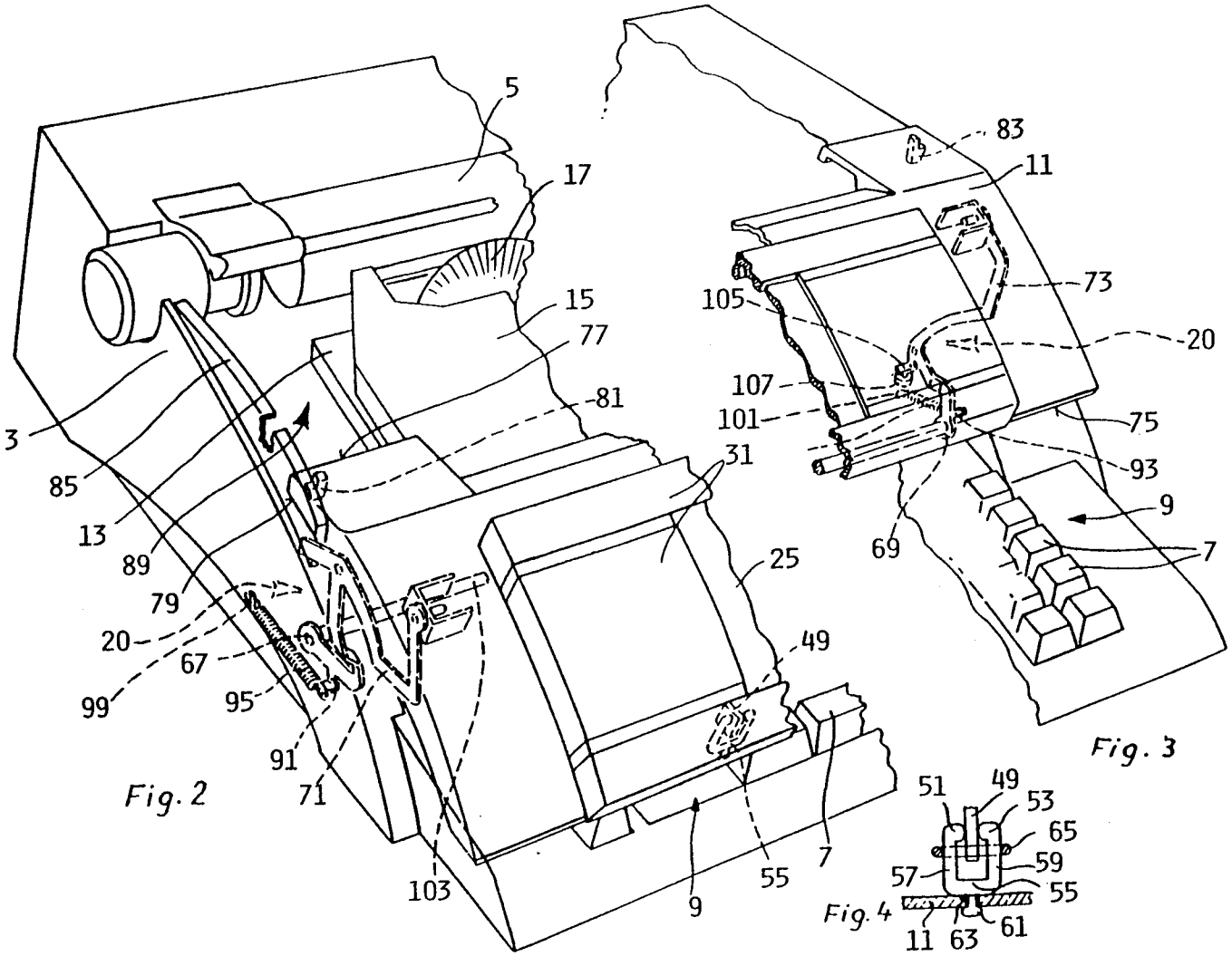
FIG. 2 is a partial perspective view of the typewriter of the preferred embodiment of FIG. 1 with the housing cover open.
FIG. 3 is a partial perspective view of the typewriter of the preferred embodiment of FIG. 1 with the housing cover closed.
FIG. 4 is a sectional view of a component of FIG. 2, shown on an enlarged scale.

Turning to FIGS. 2 and 3, details of the embodiment of FIG. 1 are shown. In order to be able to arrest frame 31 and display 25 in every infinitely variable set position, frame 31 is provided with a projecting brake arm 49. Brake arm 49 is located at the underside of one longitudinal face 47. This brake arm 49, shown on an enlarged scale in FIG. 4, is charged by two mutually resilient brake cams 51, 53 of a plastic forked brake member 55. Brake cams 51, 53 are unitary with and located at the free ends of holding arms 57, 59 of the forked brake member 55. Brake arm 49 is tightly, yet slidably, received between brake cams 51, 53, so that the operator can adjust the position of display 25 by pressing against frame 31 to overcome the frictional resistance between brake cams 51, 53 and brake arm 49; the frictional resistance is sufficiently great to hold brake arm 49 stationary relative to brake cams 51, 53 when only the force of the weight of frame 31 and display 25 acts on brake arm 49. Brake member 55 is designed to be locked in a bore 63 of housing cover 11 by means of a detent pin 61. In order to ensure a long service life for the spring action of holding arms 57, 59, a spring ring 65 presses holding arms 57, 59 and brake cams 51, 53 against one another.

Parallel guide arrangement 20 for displacement of housing cover 11 has two pivot levers 67, 69. One of these levers 67, 69 is mounted on each side of the machine frame. In the vicinity of a long front edge 75, each of pivot levers 67, 69 is articulated to housing cover 11 by a connecting arm 71, 73. In the region of a long rear edge 77 of housing cover 11, at its underside 79, parallel guide 20 has guides 81, 83 which are slidably mounted relative to guide edges 85 of upper housing portion 3. The left-hand one of guide edges 85 is shown in FIG. 2. These guide edges 85 are the side edges of an opening 89 for housing cover 11 in upper housing portion 3.

Each one of pivot levers 67, 69 is provided with a hook-in arm 91, 93 for the ends of springs 95, 97 which serve as locking members; the other ends of springs 95,97 are hung in hook-in members 99, 101 located in bottom plate 29 in such a manner that, upon displacement of housing cover 11 into the two end positions, springs 95, 97 are pushed beyond a dead center position. Thus housing cover 11 is reliably locked in its open and closed end positions without there being a need for special locking elements.

In order to prevent twisting of housing cover 11 as it is pushed into one of its end positions, the two pivot levers 67, 69 are fixed to a common pivot axis 103 rotatably mounted in the bottom plate 29. Additionally, one pivot lever 69 has a stop arm 105 for actuating a switch 107 in bottom plate 29 by means of which the current flow to the machine components can be interrupted. Switch 107 cuts off the flow of electricity and thus ensures that no functions can be initiated when housing cover 11 is open.

It will be understood that the above description of the present invention is susceptible to various modifications, changes, and adaptations, and the same are intended to be comprehended within the meaning and range of equivalents of the appended claims.

What is claimed is:

1. A housing for an office machine, said housing comprising:

an upper housing portion and a lower housing portion;

a housing cover, disposed in an opening providing in said upper housing portion, for covering functional elements of an office machine when said housing is attached to an office machine;

a parallel guide means, disposed between said housing cover and said upper and lower housing portions, for allowing said housing cover to be displaced between open and closed end positions wherein, when said housing is attached to an office machine, said housing cover is disposed closely above a keyboard of an office machine when said housing cover is in said open position and said housing cover is disposed in said opening in said upper housing portion and covers functional elements of an office machine when said housing cover is in said closed position;

means defining a rectangular recess in said housing cover;

a line display device disposed in said recess, said line display device having display means for displaying at least one complete line of text; and, means for pivotably and lockably attaching said display device to said housing cover.

2. A housing as defined in claim 1, wherein said housing cover, when in said open position, cover keys on a keyboard of an attached office machine for preventing actuation of the keys by an operator.

3. A housing as defined in claim 1, wherein; said display means displays a plurality of lines of text; and said means for pivotably and lockably attaching includes a frame embedding said display means, means for pivotably attaching said frame to said housing cover, a projecting brake arm attached to said frame, a plastic brake member having two mutually resilient brake cams attached to said housing cover, and said brake arm engages and is charged by said two resilient brake cams for releasably locking said frame in an infinite number of display positions relative to said housing cover.

4. A housing as defined in claim 3, wherein said brake member is forked to form a pair of holding arms, and each of said two brake cams is integrally attached to a respective one of said pair of holding arms.

5. A housing as defined in claim 4, wherein a spring ring presses together said pair of holding arms and said two brake cams against said projecting brake arm.

6. A housing as defined in claim 1, wherein said parallel guide means comprises:

(i) a pair of guide edges, with said guide edges being disposed at respective spaced opposed sides of said upper housing portion;

(ii) a pair of guides, with said guides being disposed at respective spaced opposed sides of said housing cover and slidably engaging respective ones of said guide edges; and (iii) a pair of pivot levers, with each said pivot lever being pivotably mounted on a pivot axis at a respective one of spaced opposed sides of one of said upper and lower housing portions and having a connecting arm whose end is articulated to a respective one of said spaced opposed sides of said housing cover.

7. A housing as defined in claim 6, wherein each said guide edge comprises a side edge of said opening for receiving said housing cover in said upper housing portion.

8. A housing as defined in claim 7, wherein: each said pivot lever includes a hook-in arm; a pair of hook-in member is provided, each said hook-in member is disposed at a respective one of spaced opposed sides of said lower housing portion; and a spring means is disposed between each said hook-in arm and a respective one of said hook-in members for releasably locking said housing cover in said open and closed end positions.

9. A housing as defined in claim 8, wherein said pivot axis of each of said pivot levers is a common pivot axis.

10. An office machine comprising:

a housing having an upper housing portion and a lower housing portion;

a printing means disposed in said upper housing portion;

a keyboard disposed in said lower housing portion, with said keyboard having a plurality of keys operatively connected to said printing means;

a housing cover disposed in an opening in said upper housing portion for covering said printing means;

a parallel guide means, disposed between said housing cover and said upper and lower housing portions, for allowing said housing cover to be displaced between open and closed end positions, said housing cover being disposed closely above said keyboard when said housing cover is in said open position and said housing cover is in said closed position;

means defining a rectangular recess in said housing cover;

a line display device disposed in said recess, said line display device having display means for displaying at least a complete line of text; and, means for pivotably and lockably attaching said display device to said housing cover.

11. An office machine as defined in claim 10, wherein said housing cover covers said plurality of keys on said keyboard for preventing actuation of the keys by an operator when said housing cover is in said open position.

12. An office machine as defined in claim 10, wherein; said display means displays a plurality of lines of text; and said means for pivotably and lockably attaching includes a frame embedding said display means, means for pivotably attaching said frame to said housing cover, a projecting brake arm attached to said frame, a plastic brake member having two mutually resilient brake cams attached to said housing cover, and said brake arm engages and is charged by said two resilient brake cams for releasably locking said frame in an infinite number of display positions relative to said housing cover.

13. An office machine as defined in claim 12, wherein said brake member is forked to form a pair of holding arms, and each of said two brake cams is integrally attached to a respective one of said pair of holding arms.

14. An office machine as defined in claim 13, wherein a spring ring presses together said pair of holding arms and said two brake cams against said projecting brake arm.

15. An office machine as defined in claim 10, wherein said parallel guide means comprises:

(i) a pair of spaced guide edges, with each said guide edge being disposed at a respective opposed side of said upper housing portion;

(ii) a pair of spaced guides, with each said guide being disposed at a respective opposed side of said housing cover and slidably engaging a respective one of said guide edge;

(iii) a pair of spaced pivot levers, with each of said pivot levers being pivotably mounted at a respective opposed side of one of said upper and lower housing portions, and having a connecting arm whose end is articulated to a respective one of said opposed sides of said housing cover.

16. An office machine as defined in claim 15, wherein each said guide edge comprises a side edge of said opening for receiving said housing cover in said upper housing portion.

17. An office machine as defined in claim 13, wherein: each said pivot lever includes a hook-in arm; a pair of hook-in members is provided, each said hook-in member is disposed at a respective one of spaced opposed sides of said lower housing portion; and a respective spring means is disposed between each said hook-in arm and a respective said hook-in member for releasably locking said housing cover in said open and closed end positions.

18. An office machine as defined in claim 17, wherein a switch is disposed in said lower housing portion for switching off the operative connection between said plurality of keys and said printing means; and a stop arm is disposed on one of said pivot levers for actuating said switch.

19. A housing for an office machine, said housing comprising:

an upper housing portion and a lower housing portion;

a housing cover disposed in an opening provided in said upper housing portion for covering functional elements of an office machine when said housing is attached to an office machine; and a parallel guide means, disposed between said housing cover and said upper and lower housing portions, for allowing said housing cover to be displaced between open and closed end positions wherein, when said housing is attached to an office machine, said housing cover is disposed closely above a keyboard of an office machine when said housing cover is in said open position and said housing cover is disposed in said opening in said upper housing and covers functional elements of an office machine when said housing cover is in said closed position, said parallel guide means including a pair of guide edges which are disposed at spaced opposed sides of said upper housing portion and are formed by a side edge of said opening in said upper housing portion, a pair of guides disposed at spaced opposed sides of said housing cover and slidably engaging respective ones of said guide edges, a pair of pivot levers pivotably mounted on a common pivot axis at respective spaced opposed sides of one of said upper and lower housing portions, with each said pivot lever having a connecting arm whose end is articulated to a respective one of said spaced opposed sides of said housing cover and a hook-in arm, a pair of hook-in members disposed at spaced opposed sides of said lower housing portion, and a respective spring means disposed between each respective said hook-in arm and a respective one of said hook-in members for releasably locking said housing cover in said open and closed end positions.

20. An office machine comprising:

a housing having an upper housing portion and a lower housing portion;

a printing means disposed in said upper housing portion;

a keyboard disposed in said lower housing portion and having a plurality of keys operatively connected to said printing means;

a housing cover disposed in an opening in said upper housing portion for covering said printing means;

a parallel guide means, disposed between said housing cover and said upper and lower housing portions, for allowing said housing cover to be displaced between open and closed end positions wherein said housing cover is disposed closely above said keyboard when said housing cover is in said open position and said housing cover covering said printing means when said housing cover is in said closed position, said parallel guide means including a pair of guide edges which are disposed at spaced opposed sides of said upper housing portion and are formed by side edges of said opening in said upper housing portion, a pair of guides disposed at spaced opposed sides of said housing cover and each slidably engaging a respective one of said guide edges, a pair of spaced pivot levers pivotably mounted at respective opposed sides of one of said upper and lower housing portions and with each said pivot lever having a connecting arm, whose end is articulated to a respective one of said spaced opposed sides of said housing cover, and a hook-in arm, a pair of hook-in members disposed respectively at spaced opposed sides of said lower housing portion, and a respective spring means disposed between a each said hook-in arm and a respective one of said hook-in members for releasably locking said housing cover in said open and closed end positions;

a switch disposed in said lower housing portion for switching off the operative connection between said plurality of keys and said printing means; and, a stop arm disposed on one of said pivot levers for actuating said switch.

* * * * *